US008669712B2

(12) United States Patent
Snijder et al.

(10) Patent No.: US 8,669,712 B2
(45) Date of Patent: Mar. 11, 2014

(54) METHOD FOR DATA PATH CREATION IN A MODULAR LIGHTING SYSTEM

(75) Inventors: Pieter Jacob Snijder, Valkenswaard (NL); Pierre Robert Valère Sonneville, Weert (NL)

(73) Assignee: Koninklijke Philips N.V., Eindhoven (NL)

( * ) Notice: Subject to any disclaimer, the term of this patent is extended or adjusted under 35 U.S.C. 154(b) by 161 days.

(21) Appl. No.: 13/375,080

(22) PCT Filed: May 25, 2010

(86) PCT No.: PCT/IB2010/052299
§ 371 (c)(1),
(2), (4) Date: Mar. 7, 2012

(87) PCT Pub. No.: WO2010/136957
PCT Pub. Date: Dec. 2, 2010

(65) Prior Publication Data

US 2012/0153850 A1 Jun. 21, 2012

(30) Foreign Application Priority Data

May 29, 2009 (EP) ..... 09161562

(51) Int. Cl.
*H05B 37/00* (2006.01)

(52) U.S. Cl.
USPC ..... 315/192; 315/185 R; 315/312; 315/291

(58) Field of Classification Search
USPC ..... 315/192, 185 R, 312–324, 291
See application file for complete search history.

(56) References Cited

U.S. PATENT DOCUMENTS

| | | | | |
|---|---|---|---|---|
| 6,150,996 | A | 11/2000 | Nicholson et al. | |
| 8,111,021 | B2 * | 2/2012 | Snijder et al. | 315/312 |
| 8,278,845 | B1 * | 10/2012 | Woytowitz | 315/307 |
| 2003/0147400 | A1 | 8/2003 | Devi | |
| 2013/0193876 | A1 * | 8/2013 | Cleland et al. | 315/297 |

FOREIGN PATENT DOCUMENTS

| | | | |
|---|---|---|---|
| DE | 102004043197 | A1 | 9/2006 |
| JP | 05046590 | A | 2/1993 |
| WO | 2007063487 | A1 | 6/2007 |

OTHER PUBLICATIONS

Wei et al., "A new approach to the traveling salesman problem using genetic algorithms with priority encoding", pp. 1457-1464, Taiwan , 2004.

* cited by examiner

*Primary Examiner* — James H Cho
(74) *Attorney, Agent, or Firm* — Mark L. Beloborodov

(57) ABSTRACT

It is disclosed a method for operating a lighting system, which lighting system comprises a plurality of lighting modules, each of which comprises at least one communication unit, via which the respective lighting module is adapted to communicate with at least one neighboring lighting module. A control device may be adapted to communicate control signals to at least one of the lighting modules and each of the lighting modules may be adapted to further communicate control signals communicated to the lighting module to a neighboring lighting module. The method comprises assigning a communication unit of each of a plurality of lighting modules to be an active communication unit associated with a minimum control signal path length value with respect to all of the communication units of the lighting module, as measured from the control device to the communication unit, whereby optimal control signal data paths, each data path being adapted to communicate control signals from the control device to a lighting module, may be formed. It is further disclosed a lighting system adapted to perform the method.

15 Claims, 4 Drawing Sheets

METHOD FOR DATA PATH CREATION IN A MODULAR LIGHTING SYSTEM

FIELD OF THE INVENTION

The present invention generally relates to the field of modular lighting. In particular, the present invention is related to a method for operating a modular lighting system.

BACKGROUND OF THE INVENTION

Light-emitting diodes (LEDs) intended for indication purposes have been used for a long time, but high-brightness LEDs, e.g. LEDs having a brightness that is high enough to enable general illumination of various locations such as rooms, have in a short period of time caused a significant growth in the LED and lighting applications market. High brightness LEDs are generally associated with a small size, a relatively high efficacy (and associated low temperature), a relatively long lifetime, a wide color gamut and ease of control. Naturally, such LEDs are of importance to lighting designers in developing new lighting applications. Such LEDs may also be utilized in replacing conventional light generation devices, such as filamented light bulbs or halogen lamps. Such LEDs are also generally capable of emitting light of various colors, which renders it possible to control the color of the light emitted from a luminaire comprising such LEDs.

In particular, light sources extending over a relatively large area, having variable color and homogeneous light distribution, may be provided by employing arrays comprising a plurality of red, green and blue LEDs covered by a light diffuser. This makes high-brightness LEDs attractive for all kinds of applications such as, for example, illumination or decoration of shop windows and public areas like exhibitions, theatres, airports etc. The ability of LEDs to provide very fast response times and the ability of LED-based RGB triplets to produce virtually any color makes LED-based RGB triples suitable for large-area lighting applications for visualizing moving color patterns or even video. Depending on LED density and/or controllability of the LEDs, such direct-view type lighting applications may range from single-color illumination panels to multi-color video displays.

While most conventional luminaries are intended to be permanently mounted at a certain location until the end of their lifespan, future LED lighting applications may have an increased emphasis on flexibility with regards to use and portability. Modular lighting is a step in this direction. Modular lighting refers to modules that can be assembled in order to obtain large lighting devices of various sizes and shapes. Notwithstanding the flexibility in adapting the size and shape of such modular lighting applications to the available space where the modular lighting application is to be installed, such modular lighting applications may be used to visualize moving light patterns (or video) on a screen that may have a size and a shape that in general deviates from standard rectangular liquid crystal display (LCD) devices. Substantially two-dimensional modules are sometimes referred to as tiles. Such a module may comprise various polygonal shapes, such as for example a square, triangle or pentagon shape. The modules are not limited to two-dimensional shapes but may have a three-dimensional shape, such as a cube or a pyramid. Portability may be improved by limiting the size of the individual modules. Fields of application for such modular lighting may for example be digital signage and atmosphere creation.

Conventionally, modules are usually mounted on a supporting frame and interconnected electrically by means of wiring and connectors. Other conventional systems make use of a wired lighting communication protocol, such as DMX512, to establish data communication with some external light pattern generator. Modules capable of wireless interconnection are also known.

In general, a modular lighting system is controlled by an external controller connected to at least one of the modules and serving as a light pattern generator for at least a portion of the lighting system. For driving the lighting system, the external controller in general needs to know about the exact geometric configuration of the lighting system beforehand (i.e. prior to or at power-up) and furthermore needs to have access to data paths interconnecting all modules, via which data paths the external controller may supply individual modules with temporally varying data (e.g. regarding luminance and color). However, the geometric shape and/or size of the modular lighting system is in general unknown to the external controller at power-up of the lighting system. Moreover, the geometric shape and/or size of the modular lighting system may change during operation of the lighting system, whereby already established data paths may be rendered defunct or inefficient (i.e. not optimal with regards to data path length from the external controller to a particular module).

Conventionally, optimal data paths are required to be programmed into the external controller prior to power-up of the lighting system by a skilled programmer. However, in this way slight modifications of the geometric shape and/or size of the lighting system during operation thereof, e.g. in response to a change of location of the lighting system, adaptation to user requirements, etc., requires an adaptation of the lighting software of the external controller. Thus, the presence of the skilled programmer during the entire period of operation of the lighting system is in general required.

SUMMARY OF THE INVENTION

It is with respect to the above considerations and others that the present invention has been made. The present invention seeks to mitigate, alleviate or eliminate one or more of the above-mentioned deficiencies and disadvantages singly or in combination. In particular, the inventors have realized that it would be desirable to achieve a modular lighting system capable of automatically generating optimal data paths. The inventors have further realized that it would be desirable to achieve a modular lighting system capable of automatically adapting the data paths to a change in the geometric shape and/or size of the lighting system during operation thereof (i.e. on the-fly).

To better address one or more of these concerns, methods and devices having the features as defined in the independent claims are provided. Further advantageous embodiments of the present invention are defined in the dependent claims.

According to a first aspect of the present invention, there is provided a method for operating a lighting system, which lighting system comprises a plurality of lighting modules. Each of the lighting modules comprises at least one communication unit, and each lighting module is adapted to communicate with at least one neighboring lighting module via one of the at least one communication unit. The lighting system further comprises a control device adapted to communicate control signals to at least one of the lighting modules, wherein each of the lighting modules is adapted to further communicate control signals, communicated to the lighting module, to a neighboring lighting module. The method comprises, for each of a predetermined plurality of communication units, reading and incrementing a value comprised in a control signal received by the communication unit by a predetermined increment, wherein the value is indicative of the number of lighting modules the control signal have passed through before reaching the communication unit, and storing a control signal path-length value comprising the incremented value within the communications unit. The method comprises, for each of the lighting modules associated with the predetermined plurality of communication units, assigning the communication unit of the each lighting module associated with a minimum control signal path length value with respect to all of the communication units of the lighting module as an active communication unit. In other words, when compared with the control signal path lengths from the control device to each of the communication units of the lighting module, the communication unit of the lighting module that is associated with the lowest control signal data path length, as measured from the control device to the communication unit, is assigned to be an active communication unit. The active communication unit is such that communication of control signals via the active communication unit is optimal with regards to control signal path-length compared to communication of control signals via any other communication unit of the lighting module, whereby optimal control signal data paths, each data path being adapted to communicate control signals from the control device to a lighting module, are formed.

By such a method, there is provided a modular lighting system that can enable forming in general one data path from the control device of the lighting system to each lighting module in the lighting system that is the shortest possible route from the control device to the lighting module. In such a data path, lighting data, control data, etc., may be forwarded to the lighting module in a serial fashion. Such a method may advantageously be performed at the start-up (power-up) of the modular lighting system, such that optimal data paths with regards to control signal path-length for lighting modules of the system may be formed and utilized during subsequent operation of the lighting system. In this manner, such a method can enable communication of data, such as data related to luminance, color, etc., to individual light-emitting elements (e.g. LEDs) of a lighting module in an optimal manner with regards to data path length from the control device to the lighting module.

In case of changes to the lighting system, such as changes to the geometrical configuration of the lighting system (e.g. by removal, replacing or interchanging individual lighting modules) and/or size of the lighting system (i.e. the number of lighting modules comprised in the lighting system) occurs, e.g. on the fly during operation of the lighting system, a method according to some embodiments of the present invention may automatically adapt for the changes by simply performing the method once again (e.g. by restarting the lighting system) to adapt the data paths to the possibly new state of the lighting system.

In the context of some embodiments of the present invention, by "active communication unit" of a particular lighting module it is referred to the communication unit of the lighting module that is preferred in relaying control signals, received from another lighting module, to a neighboring lighting module, regardless of if the general direction of the control signals is away from the control device or towards the control device (further described in the following).

As already indicated in the foregoing, in the context of some embodiments of the present invention, by an "optimal control signal data path" it is meant a data path from the control device to a particular lighting module, or vice versa (further described in the following), formed between interconnected lighting modules in the lighting system such that the data path is one of the shortest paths, or the shortest path, from the control device to the particular lighting module, or vice versa.

The communication between lighting modules in the lighting system may be performed in a wireless or wired fashion.

Each lighting module comprised in the lighting system may be adapted to enable individual control of light-emitting elements (e.g. LEDs) of the lighting module on the basis of received control signals.

According to a second aspect of the present invention, there is provided a lighting system comprising a plurality of lighting modules, each of the lighting modules comprising at least one communication unit including a memory unit, wherein each lighting module is adapted to communicate with at least one neighboring lighting module via one of the at least one communication unit. The lighting system comprises a control device adapted to communicate control signals to at least one of said lighting modules, wherein each of the lighting modules is adapted to further communicate control signals, communicated to the lighting module, to a neighboring lighting module. Each of a predetermined plurality of communication units may be adapted to read and increment a value comprised in a control signal received by the communication unit by a predetermined increment, wherein the value is indicative of the number of lighting modules the control signal has passed through before reaching said communication unit, and store an associated control signal path-length value comprising the incremented value in the memory unit of the communication unit. Each of the lighting modules associated with the predetermined plurality of communication units is further adapted to assign the communication unit of the each lighting module associated with a minimum control signal path-length value with respect to all of the communication units of the lighting module to be an active communication unit. The active communication unit may be adapted such that communication of control signals via the active communication unit is optimal with regards to control signal path-length compared to communication of control signals via any other communication unit of the lighting module, whereby optimal control signal data paths, each data path being adapted to communicate control signals from said control device to a lighting module, are formed.

By a lighting system according to the second aspect of the present invention, advantages similar to or the same as the advantages of the method according to the first aspect of the present invention may be achieved.

According to a third aspect of the present invention, there is provided a computer program product adapted to, when executed in a processor unit, perform a method according to the first aspect of the present invention or any embodiment thereof According to a fourth aspect of the present invention, there is provided a computer-readable storage medium on which there is stored a computer program product adapted to, when executed in a processor unit, perform a method according to the first aspect of the present invention or any embodiment thereof.

According to an exemplifying embodiment of the present invention, if a communication unit of a lighting module other than the active communication unit of the lighting module reads and increments a value such that the incremented value is equal to the control signal path-length value stored in a memory unit of the active communication unit of the lighting module, the communication unit currently assigned as the active communication unit of the lighting module may be maintained as the active communication unit of the lighting module.

Such a configuration may enable maintaining the current active communication unit of a particular lighting module as the active communication unit if a new value indicative of the control signal module pass-through count number equal to the control signal path-length value stored in a memory unit of the active communication unit of the lighting module, e.g. as a result of an on-the-fly geometrical reconfiguration of the lighting system while keeping the lighting system in an operative state, is received by a communication unit other than the current active communication unit, as there in such a case is no reason to change the assignment of the active communication unit. Only if the new value indicative of the control signal module pass-through count number is less than the control signal path-length value stored in a memory unit of the active communication unit of the lighting module the assignment of the active communication should be changed.

According to another embodiment of the present invention, it may be sensed whether control signals have been received by a set of at least one lighting module during a predetermined control signal generation period. In case no control signals have been received by a lighting module of the set module during the predetermined control signal generation period, for each communication unit of the lighting module a value comprised in a control signal received by said communication unit may be read and incremented by a predetermined increment, the value being indicative of the number of lighting modules the control signal have passed through before reaching the communication unit, and a control signal path-length value comprising the incremented value may be stored within the communications unit. Furthermore, for the lighting module having received no control signals during the predetermined control signal generation period, the communication unit of the lighting module associated with a minimum control signal path-length value with respect to all of the communication units of the lighting module may be assigned as an active communication unit, such that communication of control signals via the active communication unit is optimal with regards to control signal path-length compared to communication of control signals via any other communication unit of the lighting module, whereby an optimal control signal data path, adapted to communicate control signals from the control device to the lighting module, is formed.

Such a configuration may enable data path creation to be re-executed in case a lighting module detects loss of received data, for the particular lighting module only, without having to go through the data path creation process for the entire lighting system. This may involve disabling the output of all communication units of the particular lighting module, whereby further lighting modules may be forced to re-establish a new data source.

According to another embodiment of the present invention, each of the active communication units may be adapted to read from control signals received by the active communication unit information indicative of how the lighting modules of the lighting system are arranged in relation to each other.

According to yet another embodiment of the present invention, the information indicative of how the lighting modules of the lighting system are arranged in relation to each other may comprise information indicative of from which communication unit of the neighboring lighting module, from which the control signals were received, the control signals were communicated to the active communication unit.

In general, when installing the lighting system at a location, the lighting modules are assembled in relation to each other in a suitable manner, for example in an array configuration. By the information indicative of how the lighting modules are arranged in relation to each other, the two embodiments described immediately in the foregoing may enable adjusting (e.g. rotating) the orientation of the visual content displayed by a particular lighting module in order to adapt to visual content displayed by other (e.g. neighboring) lighting modules, thereby providing orientation-insensitivity (or rotation-insensitivity) of lighting modules with respect to the other lighting modules in the geometric arrangement of the lighting system. Hence, by the two embodiments described immediately in the foregoing, there is in general no need for individual lighting modules to have some marking indicative of the proper orientation of the lighting module in which it should be installed in the assembly of lighting modules. In other words, the need for a "this-side-up" mark or the like arranged on the lighting modules may be eliminated. Thus, the lighting modules may be assembled in random orientations, and after installation the orientation of the visual content of the lighting modules may be adapted so as to harmonize with the visual content of other (e.g. neighboring) lighting modules. In this manner, assembly of the lighting system may be performed in a quick and efficient manner. Furthermore, this can enable the lighting system to adapt itself to changes to the lighting system, such as changes to the geometrical configuration of the lighting system (e.g. by removal, replacing or interchanging individual lighting modules) and/or size of the lighting system (i.e. the number of lighting modules comprised in the lighting system), as a cause of which the visual content displayed by new or changed lighting modules may not be properly oriented with respect to other (e.g. neighboring) lighting modules. Such changes may for example occur on-the-fly during operation of the lighting system.

According to another embodiment of the present invention, each of the active communication units may be adapted to read from control signals received by the active communication unit an address of the neighboring lighting module from which the control signals were received. On the basis of the address, the active communication units may be adapted to derive an address of the lighting module associated with the active communication unit.

Such a configuration may enable providing each lighting module with an address that is unique with respect to the entire lighting system. As control signals communicated via the control device to the lighting modules may be provided with such a unique address for each block of data in the control signals, each lighting module may extract from the control signals the data intended for the lighting module itself.

According to yet another embodiment of the present invention, the lighting modules may be arranged in an array and the address may be derived further on the basis of the geometric configuration of the array, wherein said address comprises data indicative of the row and column in the array that are associated with the lighting module comprising the active communication unit.

Such a configuration may enable providing each lighting module with an address that is unique with respect to the entire lighting system. As control signals communicated via the control device to the lighting modules may be provided with such a unique address for each block of data in the control signals, each lighting module may extract from the control signals the data intended for the lighting module itself. Furthermore, by means of the array configuration, the addresses of all the lighting modules may be logically interrelated, which may be utilized in order to enable the control device to reconstruct the entire array of lighting modules without any external intervention or assistance, e.g. by a user.

In the context of some embodiments of the present invention, by "array" it is referred to a systematic arrangement of multiple components.

According to yet another embodiment of the present invention, each of the optimal control signal data paths may be further adapted to communicate data from the respective lighting module to the control device, thereby forming a data return path.

In this manner, data return paths along which the lighting modules may communicate data back to the control device may be implemented, the data return paths running parallel with the optimal data paths but in the opposite direction. Such data communicated back to the control device may include, but is not limited to, data indicative of the addresses of the respective lighting modules.

The temporal density of data that is returned to the control device from the lighting modules via such data return paths may increase as the distance to the control device decreases. To this end, lighting modules may be adapted to reduce data collision and overflow, for example by means of temporal data storage units comprised e.g. in the communication units of the respective lighting modules.

According to yet another embodiment of the present invention, each of the optimal control signal data paths may be further adapted to communicate data from the respective lighting module to the control device, thereby forming a data return path. The lighting module may be further adapted to return the address of the lighting module to the control device via the data return path at a predetermined address return rate.

By returning the addresses of the lighting modules at regular intervals, such a configuration may for example enable the control device to keep track of any possible changes of the size, and also of the shape, of the entire lighting system the control device is driving. For example, the removal of a lighting module may be indicated to the control device by the fact that the address of the lighting module is detected to be missing from the stream of data (among other things, lighting module addresses) that is returned to the control device at a predetermined rate. The address return rate may be about 100 Hz (i.e. the address of a lighting module may be communicated to the control device from the lighting module about every 10 ms).

According to yet another embodiment of the present invention, the control device may be adapted to store addresses of lighting modules returned to the control device via data return paths and generate bookkeeping data for the system of lighting modules. At a predetermined bookkeeping updating rate, the control device may be adapted to update the bookkeeping data.

Updating of bookkeeping data may enable the control device to keep track of possible changes of the lighting modules of the entire lighting system that the control device is driving, not only changes to size and/or shape of the lighting system as has already been discussed above, but also changes referring to other characteristics of the entire lighting system or individual lighting modules. For instance, such bookkeeping data may include, but is not limited to, addresses of the lighting modules, neighboring module information (e.g. information indicative of which lighting modules that are neighboring a particular lighting module), flags (or tokens) indicative of different states a lighting module may be in and/or which state the lighting module currently is in, the identity of the current active communication unit of each lighting module, etc.

According to yet another embodiment of the present invention, each of the communication units may be adapted to detect the receipt of a control signal anticipation signal generated by the control device at a predetermined anticipation signal generation rate.

In this manner, the need for the lighting modules (or communication units) to be in state of actively listening to detect the occurrence of control signal may be mitigated or eliminated, as each of the communication units may postpone listening to detect the occurrence of control signals until the communication unit has detected receipt of a control signal anticipation signal. In this manner, power consumption may be reduced compared to a case where communication units constantly are in a state of actively listening to detect the occurrence of control signals.

Furthermore, such a configuration may alternatively or optionally serve as a synchronization signal preceding the transmittal of other data streams sent by the control device to the lighting modules. For example, such a configuration can enable the control device to send a control signal anticipation signal at a given instant in time, at the receipt of which each communication unit begins actively to listening to detect the occurrence of control signals.

According to yet another embodiment of the present invention, for each of the lighting modules, if the minimum control signal path-length with respect to all of the communication units of the lighting module is associated with more than one of the communication units of the lighting module, the lighting module may be adapted to assign a first communication unit in a first direction of a succession of communication units of the lighting module, each of the communication units being associated with the minimal control signal path-length with respect to all of the communication units of the lighting module, as the active communication unit.

In other words, if more than one of the communication units of a particular lighting module is associated with the minimum control signal path-length with respect to all of the communication units of the lighting module, the above rule or manner in assigning the active communication unit of the lighting module may be employed. In this manner, ambiguity in selecting (assigning) the active communication unit of the lighting module may be mitigated or eliminated.

Further objects and advantages of the various embodiments of the present invention will be described below by means of exemplifying embodiments.

The steps of any method disclosed herein do not have to be performed in the exact order disclosed, unless explicitly stated.

It is noted that the invention relates to all possible combinations of features recited in the claims.

BRIEF DESCRIPTION OF THE DRAWINGS

Exemplifying embodiments of the invention will be described below with reference to the accompanying drawings, in which.

In the accompanying drawings, the same reference numerals denote the same or similar elements throughout the views.

DETAILED DESCRIPTION

The present invention will now be described more fully hereinafter with reference to the accompanying drawings, in which exemplifying embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Furthermore, like numbers refer to like or similar elements throughout.

Figure 1:
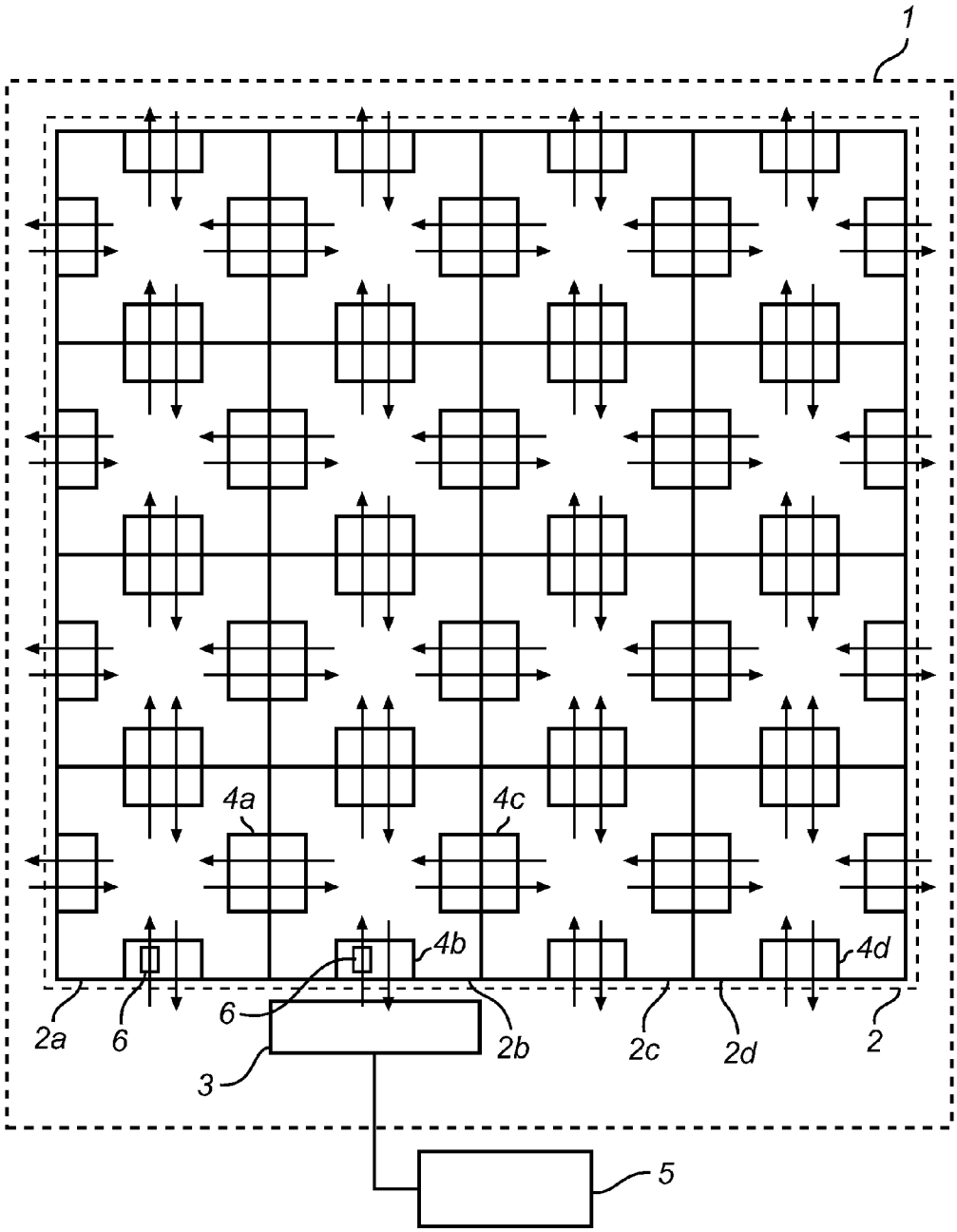
FIGS. 1-3 are schematic views of exemplifying embodiments of the present invention.

Referring to FIG. 1, there is shown a schematic view of a modular lighting system 1 according to an exemplifying embodiment of the present invention, comprising a plurality 2 of lighting modules 2*a*, 2*b*, 2*c*, 2*d*, . . . and a control device 3. Each of the lighting modules 2*a*, 2*b*, 2*c*, 2*d*, . . . (of which only a few are indicated by reference numerals in FIG. 1) may comprise a plurality of communication units 4*a*, 4*b*, 4*c*, 4*d*, . . . , respectively (of which only a few are indicated by reference numerals in FIG. 1). Each lighting module 2*a*, 2*b*, 2*c*, 2*d*, . . . may be adapted to communicate with at least one neighboring lighting module, or with another neighboring element, via one of its communication units 4*a*, 4*b*, 4*c*, 4*d*, . . . , respectively. For example, each lighting module 2*a*, 2*b*, 2*c*, 2*d*, . . . may be adapted to communicate control signals, communicated to the respective lighting module, to a neighboring lighting module, or to another neighboring element, via one of its communication units 4*a*, 4*b*, 4*c*, 4*d*, . . . , respectively. This is indicated in FIG. 1 by the two-way arrows, which represent possible data paths from and to each of the lighting modules of the plurality 2 of lighting modules. Thus, by means of the communication units 4*a*, 4*b*, 4*c*, 4*d*, . . . , a lighting module 2*a*, 2*b*, 2*c*, 2*d*, . . . may transmit and receive signals from a neighboring lighting module or another element capable of transmitting signals to and/or receiving signals from a communication unit of the respective lighting module 2*a*, 2*b*, 2*c*, 2*d*, . . . .

With further reference to FIG. 1, the control device 3 may be adapted to communicate control signals to at least one of the lighting modules, for example effectuated by means of communication wires. The control signals may be generated by an external source 5, which for example may comprise a central processing unit of a computer (not shown). The control device 3 may alternatively be integrated in, or be, such a central processing unit.

According to the exemplifying embodiment depicted in FIG. 1, the lighting modules 2*a*, 2*b*, 2*c*, 2*d*, . . . of the lighting system 1 are arranged in an array of lighting modules comprising a four-by-four array configuration of square-shaped lighting modules. Such a four-by-four array configuration of lighting modules is shown by way of example only and should not be construed as limiting the present invention, which rather encompasses embodiments comprising lighting systems comprising any number of lighting modules, having an arbitrary geometrical shape, e.g. a polygonal shape, which lighting modules may be arbitrarily arranged in relation to each other, and not merely in a regular array of square lighting modules such as exemplary depicted in FIG. 1. With further reference to FIG. 1, each of the lighting modules 2*a*, 2*b*, 2*c*, 2*d*, . . . comprises four communication units 4*a*, 4*b*, 4*c*, 4*d*, . . . , respectively. However, the number of communication units of each lighting module is arbitrary and may be adapted to user requirements and/or lighting requirements. For example, in a lighting system comprising a plurality of triangle-shaped lighting modules (not shown), the number of communication units of each lighting module may for example be three.

Figure 2:
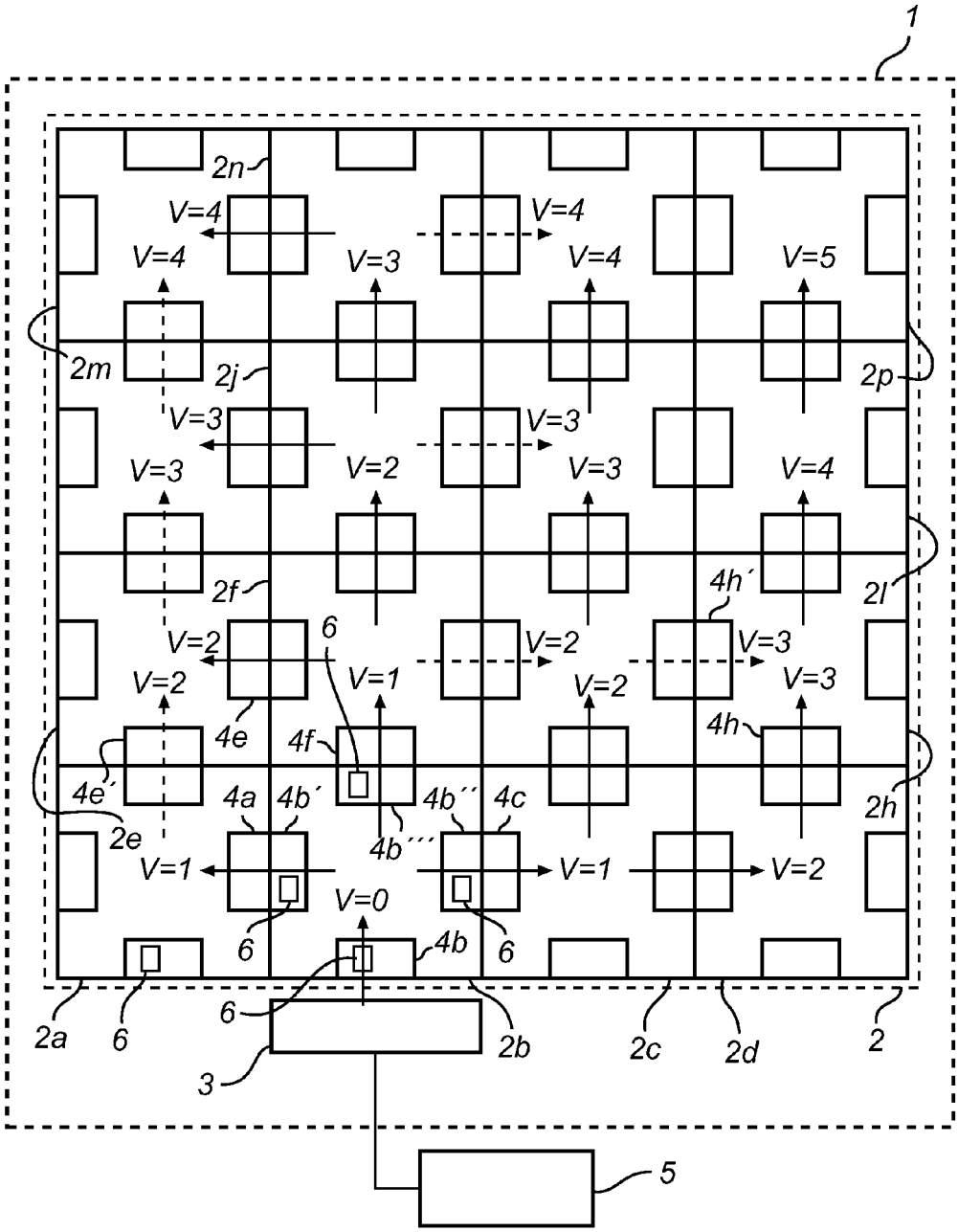

Referring now to FIG. 2, there is shown a schematic view of a lighting system 1 according to an exemplifying embodiment of the present invention. The lighting system 1 depicted in FIG. 2 comprises components similar to or the same and having similar or the same function as components comprised in the lighting system described with reference to FIG. 1. The description of such similar or identical components with reference to FIG. 2 is therefore omitted. FIG. 2 illustrates the general principles of an embodiment of the present invention, as described in the following. The control device 3 may receive control signals from the external source 5, which control signals may be further communicated to at least one of the lighting modules of the lighting system 1 (e.g. to the lighting module 2*b* as indicated in FIG. 2). Optionally or alternatively, control signals may be generated in the control device 3 itself and communicated to at least one of the lighting modules of the lighting system 1. According to the depicted embodiment, control signals are communicated from the control device 3 to the lighting module 2*b* via the communication unit 4*b* of the lighting module 2*b*. In turn, the lighting module 2*b* may be adapted to communicate control signals received by the communication unit 4*b* to neighboring lighting modules 2*a*, 2*c*, 2*f* via its other communication units 4*b*', 4*b*" and 4*b*'", respectively, that are received by the communication units 4*a*, 4*f*, 4*c* of the lighting modules 2*a*, 2*f* and 2*c*, respectively.

With further reference to FIG. 2, each of the communication units of the lighting modules of the lighting system 1 may be adapted to read and increment a value comprised in a control signal received by the communication unit by a predetermined increment, the value being indicative of the number of lighting modules the control signal has passed through before reaching the communication unit. For this purpose, a control signal may for example comprise a frame, or field, that is updated appropriately in response to the control signal passing a lighting module. According to the exemplifying embodiment described with reference to FIG. 2, starting at the communication unit 4*b* a control signal may pass through the communication unit 4*b*, as indicated by the arrow through the communication unit 4*b*, on which the communication unit 4*b* may increment the value by 1, and stores a control signal path-length value V associated therewith, comprising the incremented value, in a memory unit 6 of the communication unit 4*b*. In the depicted example, V is set to 0, indicating that the control signal has passed through no lighting module before reaching the communication unit 4*b* (implying that the value initially was set to −1). Then, control signals are communicated from the lighting module 2*b* to neighboring lighting modules 2*a*, 2*c*, 2*f* via the communication units 4*b*', 4*b*" and 4*b*'", respectively (indicated by the respective arrows therethrough), that are received by the communication units 4*a*, 4*f*, 4*c* of the lighting modules 2*a*, 2*f* and 2*c*, respectively. Each of the communication units 4*b*', 4*b*'", 4*b*" sets the value V to 1 (V=1), as the respective control signals received by the communication units 4*a*, 4*f*, 4*c* of the lighting modules 2*a*, 2*f* and 2*c*, respectively, have passed through one lighting module before reaching the respective communication unit. The value V=1 may then be stored in a memory unit 6 comprised in each of the communication units 4*b*', 4*b*", 4*b*'". In the same manner, the lighting modules 2*a*, 2*f*, 2*c* may communicate control signals to neighboring lighting modules 2*e*, 2*j*, 2*g*, 2*d*, and the communication units of the respective lighting modules receiving the control signals may increment and store a value V in a memory unit, such as further indicated in FIG. 2. Although the memory units 6 of only a few communication units in FIG. 2 are shown, each of the communication units in the lighting system 1 may comprise such a memory unit 6.

After control signals have been communicated from the control device 3 so as to reach a number of lighting modules of the lighting system 1, each of these lighting modules may be adapted to assign the communication unit of the lighting module associated with a minimum control signal path-length value $V_{min}$ (in other words, the smallest or one of the smallest control signal path-length values) with respect to all of the communication units of the lighting module as an "active" communication unit. Such an active communication unit may be adapted such that communication of control signals via the active communication unit is optimal with regards to control signal path-length compared to communication of control signals via any other communication unit of the lighting module.

It may happen that more than one of the communication units of a particular lighting module is associated with the minimum control signal path-length value $V_{min}$ with respect to all of the communication units of the lighting module. In such a case, the particular lighting module may be adapted to assign a first communication unit in a first direction of a succession of communication units of the lighting module, each of these communication units being associated with the minimal control signal path-length with respect to all of the communication units of the lighting module, as the active communication unit. In this manner, ambiguity in selecting (assigning) the active communication unit of the lighting module may be mitigated or eliminated. By way of example, this is indicated in FIG. 2 for the lighting modules 2*e* and 2*h*. With respect to the lighting module 2*e*, the communication unit 4*e* has been set as the active communication unit and not the communication unit 4*e*', by selecting the first communication unit of the communication units 4*e*, 4*e*' in a clockwise direction (i.e. the communication unit 4*e*) as the active communication unit. In this manner, preference is given to the data path from the control device 3 to the communication unit 4*e* in communication of control signals from the control device 3 to the lighting module 2*e* over the data path from the control device 3 to the communication unit 4*e*' in communication of control signals from the control device 3 to the lighting module 2*e*. Applying a similar rule as described in the foregoing, the communication unit 4*h* of the lighting module 2*h* may be selected as the active communication unit of the lighting module 2*h*. In this manner, preference is given to the data path from the control device 3 to the communication unit 4*h* in communication of control signals from the control device 3 to the lighting module 2*h* over the data path from the control device 3 to the communication unit 4*h*' in communication of control signals from the control device 3 to the lighting module 2*h*.

With further reference to FIG. 2, in view of the foregoing discussion with respect to FIG. 2, the active communication unit of each lighting module of the lighting system 1 is indicated by the communication unit of each lighting module being closest to the point in the solid arrows. For illustrating the principles of embodiments of the present invention, the communication unit of some of the lighting modules being closest to the point in the dashed arrows indicate a communication unit of the respective lighting module being associated with a control signal path-length value that is equal to the control signal path-length value of the active communication unit of the respective lighting module. However, as a result of the application of the rule for unambiguously assigning (selecting) the active communication unit, the communication units being closest to the point in the dashed arrows have not been selected as the active communication unit of the respective lighting module.

Thus, in view of the above discussion, the solid arrows in FIG. 2 indicate preferred data paths for communicating control signals from the control device 3 to the respective lighting modules in the lighting system 1. Each such preferred data path for communicating control signals from the control device 3 to a lighting module is thus such that it is optimal with regards to control signal path-length, or as short as possible. For instance, the preferred data path for communicating control signals from the control device 3 to the lighting module 2*e* goes from the control device 3 to the lighting module 2*b* to the lighting module 2*f* to the lighting module 2*e*. According to further examples, the preferred data path for communicating control signals from the control device 3 to the lighting module 2*p* goes via lighting modules 2*b*, 2*c*, 2*d*, 2*h* and 2*l*, in that order, and the preferred data path for communicating control signals from the control device 3 to the lighting module 2*m* goes via lighting modules 2*b*, 2*f*, 2*j*, and 2*n*, in that order.

Figure 3:
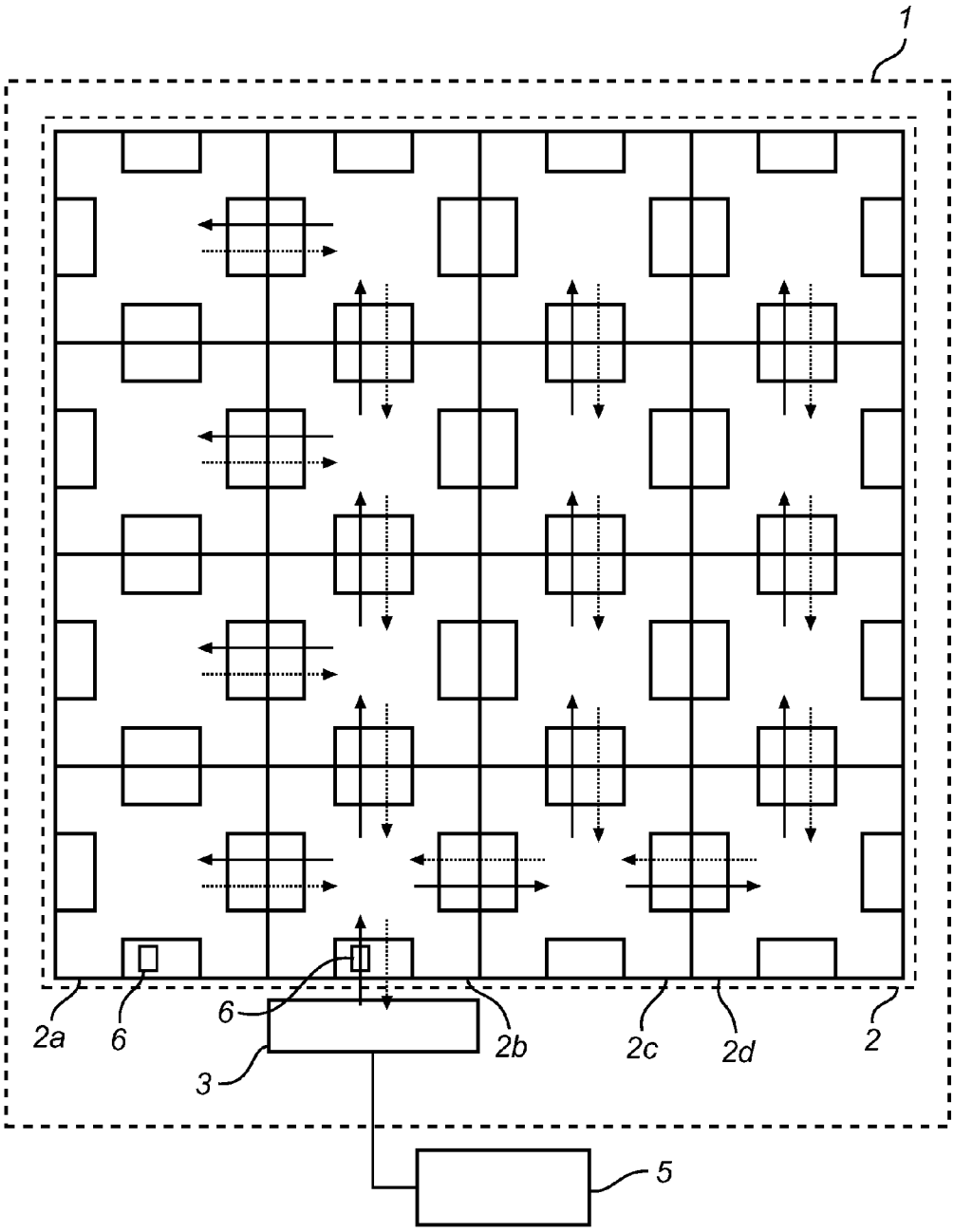

Referring now to FIG. 3, there is shown a schematic view of a lighting system 1 according to an exemplifying embodiment of the present invention. The lighting system 1 depicted in FIG. 3 comprises components similar to or the same and having similar or the same function as components comprised in the lighting system described with reference to FIG. 1 or 2. The description of such similar or identical components with reference to FIG. 3 is therefore omitted. FIG. 3 illustrates the general principles of an embodiment of the present invention, as described in the following. With reference to FIG. 3, each of the preferred, or optimal, control signal data paths may be adapted to communicate data from the respective lighting module to the control device 3, thereby forming a data return path from the respective lighting module to the control device 3, running parallel with the data path from the control device 3 to the respective lighting module but in opposite direction. In this manner, various data may be communicated from the lighting modules to the control device 3. Such return data paths are indicated in FIG. 3 by the pairs of arrows, each pair of arrows comprising a solid and a dashed arrow that are parallel with respect to each other but pointing in opposite directions. The solid arrows indicate data paths from the control device 3 and the dashed arrows indicate data return paths to the control device 3.

Figure 4:
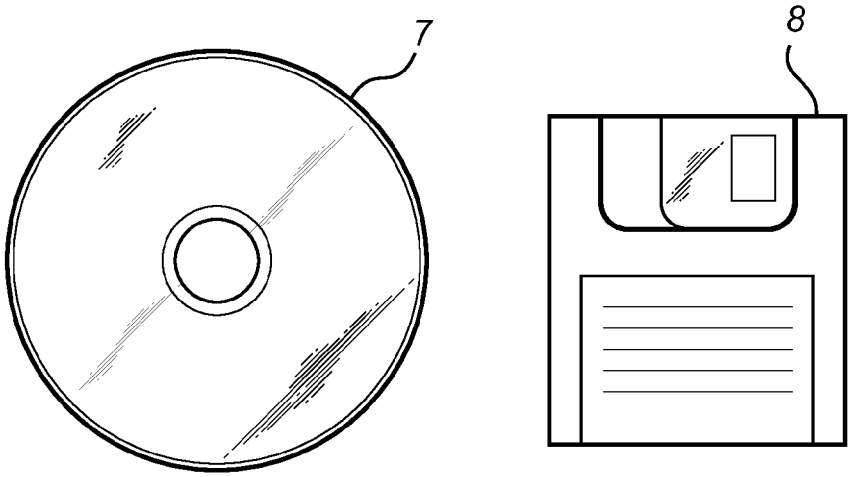
FIG. 4 is a schematic view illustrating computer readable storage mediums according to exemplifying embodiments of the present invention.

Referring now to FIG. 4, there is shown a schematic view of computer readable digital storage mediums 7, 8 according to exemplifying embodiments of the present invention, comprising a DVD 7 and a floppy disk 8 on each of which there may be stored a computer program comprising computer code adapted to, when executed in a processor unit, perform a method according to the various embodiments of the present invention, as has been described in the foregoing.

Although only two different types of computer-readable digital storage mediums have been described above with reference to FIG. 4, the present invention encompasses embodiments employing any other suitable type of computer-readable storage medium, such as, but not limited to, a hard disk drive, a CD, a flash memory, magnetic tape, a USB stick, a Zip drive, etc.

Figure 5:
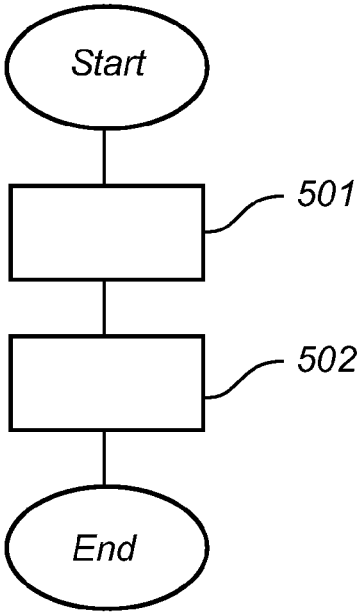
FIG. 5 is a schematic flow diagram illustrating a method according to an exemplifying embodiment of the present invention.

Referring now to FIG. 5, there is shown a schematic flow diagram illustrating a method according to an exemplifying embodiment of the present invention, for operating a lighting system such as has been discussed in the foregoing with reference to exemplifying embodiments. After the start of the method, at step 501, for each of a predetermined plurality of communication units, a value comprised in a control signal received by the communication unit may be read and incremented by a predetermined increment. The value may be indicative of the number of lighting modules the control signal has passed through before reaching the communication unit. Furthermore, at step 501, a control-signal path-length value, comprising the incremented value, may be stored within the communication unit. At step 502, for each of the lighting modules associated with the plurality of communication units, the communication unit of the lighting module associated with a minimum control signal path length value with respect to all of the communication units of the lighting module may be assigned to be an active communication unit. The active communication unit may be adapted such that communication of control signals via the active communication unit is optimal with regards to control signal path-length compared to communication of control signals via any other communication unit of the lighting module. In this manner, optimal control signal data paths, wherein each data path may be adapted to communicate control signals from the control device of the lighting system to a lighting module of the lighting system, may be formed.

In conclusion, it is disclosed a method for operating a lighting system, which lighting system comprises a plurality of lighting modules, each of which comprises at least one communication unit, via which the respective lighting module is adapted to communicate with at least one neighboring lighting module. A control device may be adapted to communicate control signals to at least one of the lighting modules and each of the lighting modules may be adapted to further communicate control signals communicated to the lighting module to a neighboring lighting module. The method comprises assigning a communication unit of each of a plurality of lighting modules to be an active communication unit associated with a minimum control signal path length value with respect to all of the communication units of the lighting module, as measured from the control device to the communication unit, whereby optimal control signal data paths, each data path being adapted to communicate control signals from the control device to a lighting module, may be formed.

Although exemplary embodiments of the present invention has been described herein, it should be apparent to those having ordinary skill in the art that a number of changes, modifications or alterations to the invention as described herein may be made. Thus, the above description of the various embodiments of the present invention and the accompanying drawings are to be regarded as non-limiting examples of the invention and the scope of protection is defined by the appended claims. Any reference signs in the claims should not be construed as limiting the scope.

The invention claimed is:

1. A method for operating a lighting system, the lighting system comprising a plurality of lighting modules, each of said lighting modules comprising at least one communication unit wherein each lighting module is adapted to communicate with at least one neighboring lighting module via one of said at least one communication unit, said lighting system further comprising a control device adapted to communicate control signals to at least one of said lighting modules, wherein each of the lighting modules is adapted to further communicate control signals, communicated to said lighting module, to a neighboring lighting module; said method comprising:

a) for each of a predetermined plurality of communication units, reading and incrementing a value comprised in a control signal-received by said communication unit by a predetermined increment, said value being indicative of the number of lighting modules said control signal has passed through before reaching said communication unit, and storing a control signal path-length value (V) comprising the incremented value within said communications unit; and b) for each of the lighting modules associated with said predetermined plurality of communication units, assigning the communication unit of said each lighting module associated with a minimum control signal path length value ($V_{min}$) with respect to all of the communication units of said lighting module to be an active communication unit, such that communication of control signals via said active communication unit is optimal with regards to control signal path-length compared to communication of control signals via any other communication unit of said lighting module, whereby optimal control signal data paths, each data path being adapted to communicate control signals from said control device to a lighting module, are formed.

2. The method according to claim 1, further comprising, if a communication unit of a lighting module other than the active communication unit of said lighting module reads and increments a value such that the incremented value is equal to the control signal path-length value stored in a memory unit of the active communication unit of said lighting module:

c) maintaining the communication unit currently assigned as the active communication unit of said lighting module as the active communication unit of said lighting module.

3. The method according to claim 1, further comprising:

d) sensing whether control signals have been received by a set of at least one lighting module during a predetermined control signal generation period; and e) if no control signals have been received by a lighting module of said set during the predetermined control signal generation period, performing a) for each communication unit of said lighting module and performing b) for said lighting module.

4. A computer program product comprising computer code adapted to, when executed in a processor unit, perform a method according to claim 1.

5. A computer-readable storage medium on which there is stored a computer program product adapted to, when executed in a processor unit, perform a method according to claim 1.

6. A lighting system comprising:

a plurality of lighting modules, each of said lighting modules comprising at least one communication unit including a memory unit, wherein each lighting module is adapted to communicate with at least one neighboring lighting module via one of said at least one communication unit; and a control device adapted to communicate control signals to at least one of said lighting modules;

wherein each of the lighting modules is adapted to further communicate control signals, communicated to said lighting module, to a neighboring lighting module;

wherein each of a predetermined plurality of communication units is adapted to read and increment a value comprised in a control signal received by said communication unit by a predetermined increment, said value being indicative of the number of lighting modules said control signal has passed through before reaching said communication unit, and store an associated control signal path-length value (V) comprising the incremented value in the memory unit of said communication unit; and wherein each of the lighting modules associated with said predetermined plurality of communication units is further adapted to assign the communication unit of said each lighting module associated with a minimum control signal path-length value with respect to all of the communication units of said lighting module to be an active communication unit, adapted such that communication of control signals via said active communication unit is optimal with regards to control signal path-length compared to communication of control signals via any other communication unit of said lighting module, whereby optimal control signal data paths, each data path being adapted to communicate control signals from said control device to a lighting module, are formed.

7. The lighting system according to claim 6, wherein each of the active communication units is adapted to read from control signals received by said active communication unit information indicative of how the lighting modules are arranged in relation to each other.

8. The lighting system according to claim 7, wherein said information comprises information indicative of from which communication unit of the neighboring lighting module, from which said control signals were received, said control signals were communicated to said active communication unit.

9. The lighting system according to claim 6, wherein each of the active communication units is adapted to read from control signals received by said active communication unit an address of the neighboring lighting module from which said control signals were received, and, on the basis of said address, derive an address of the lighting module associated with said active communication unit.

10. The lighting system according to claim 9, wherein the lighting modules are arranged in an array and said address is derived further on the basis of the geometric configuration of said array, wherein said address comprises data indicative of the row and column in said array that are associated with the lighting module comprising said active communication unit.

11. The lighting system according to claim 9, wherein each of said optimal control signal data paths is further adapted to communicate data from the respective lighting module to said control device, thereby forming a data return path, and wherein said lighting module is further adapted to return the address of said lighting module to the control device via said data return path at a predetermined address return rate.

12. The lighting system according to claim 11, wherein said control device is further adapted to store addresses of lighting modules returned to the control device via data return paths and generate bookkeeping data for said system of lighting modules, and, at a predetermined bookkeeping updating rate, update said bookkeeping data.

13. The lighting system according to claim 6, wherein each of said optimal control signal data paths is further adapted to communicate data from the respective lighting module to said control device, thereby forming a data return path.

14. The lighting system according to claim 6, wherein each of the communication units is further adapted to detect the receipt of a control signal anticipation signal generated by the control device at a predetermined anticipation signal generation rate.

15. The lighting system according to claim 6, wherein, for each of the lighting modules, if the minimum control signal path-length with respect to all of the communication units of said lighting module is associated with more than one of the communication units of the lighting module, said lighting module is further adapted to assign a first communication unit in a first direction of a succession of communication units of said lighting module associated with the minimal control signal path-length with respect to all of the communication units of said lighting module as the active communication unit.

* * * * *